US009931627B2

(12) United States Patent
Sanchez

(10) Patent No.: US 9,931,627 B2
(45) Date of Patent: Apr. 3, 2018

(54) SAMPLING PIPETTE HAVING AN IMPROVED DEVICE FOR ADJUSTING AND DISPLAYING A VOLUME TO BE SAMPLED

(71) Applicant: GILSON SAS, Villiers le Bel (FR)

(72) Inventor: Marc Sanchez, Paris (FR)

(73) Assignee: GILSON SAS, Villiers le Bel (FR)

( * ) Notice: Subject to any disclaimer, the term of this patent is extended or adjusted under 35 U.S.C. 154(b) by 110 days.

(21) Appl. No.: 15/021,493

(22) PCT Filed: Sep. 9, 2014

(86) PCT No.: PCT/EP2014/069184
§ 371 (c)(1),
(2) Date: Mar. 11, 2016

(87) PCT Pub. No.: WO2015/036397
PCT Pub. Date: Mar. 19, 2015

(65) Prior Publication Data

US 2016/0228868 A1 Aug. 11, 2016

(30) Foreign Application Priority Data

Sep. 12, 2013 (FR) ..... 13 58770

(51) Int. Cl.
*B01L 3/02* (2006.01)

(52) U.S. Cl.
CPC ..... *B01L 3/0224* (2013.01); *B01L 2200/08* (2013.01); *B01L 2200/148* (2013.01);
(Continued)

(58) Field of Classification Search
CPC ..... B01L 3/0224; B01L 3/021; B01L 3/0217; B01L 2200/08; B01L 2200/148;
(Continued)

(56) References Cited

U.S. PATENT DOCUMENTS 3,982,899 A * 9/1976 Kelm ..... B01L 3/0224 222/309
4,395,921 A 8/1983 Oppenlander
(Continued)

FOREIGN PATENT DOCUMENTS

| | | |
|---|---|---|
| DE | 10 2012 102292 A1 | 8/2013 |
| EP | 2 633 915 A2 | 9/2013 |
| FR | 2 203 680 A1 | 5/1974 |

OTHER PUBLICATIONS

Preliminary French Search Report for FR1358770 (dated May 14, 2014).

(Continued)

*Primary Examiner* — Justin Olamit
(74) *Attorney, Agent, or Firm* — Miles & Stockbridge P.C.

(57) ABSTRACT

A top part for a sampling pipette including a hollow outer body forming a handle, a pipetting control stem, a device for adjusting and displaying a volume to be sampled, including a first threaded member for adjusting the volume to be sampled crossed by the control stem, the device also comprising a set of first volume graduations angularly spaced from one another around the longitudinal axis and cooperating with a first mark so as to inform about the volume to be sampled. The first threaded member is rotatably integral with one of both elements formed by the set of first volume graduations and the first mark, the mark being axially arranged between the hollow outer body forming a handle and the control knob.

22 Claims, 6 Drawing Sheets

(52) U.S. Cl.
CPC ... *B01L 2300/026* (2013.01); *B01L 2300/028* (2013.01); *B01L 2400/0478* (2013.01)

(58) Field of Classification Search
CPC ..... B01L 2300/025; B01L 2300/026; B01L 2300/028; B01L 2400/0478; A61M 5/31528; A61M 5/3155; A61M 5/31551; A61M 5/3156
See application file for complete search history.

(56) References Cited

U.S. PATENT DOCUMENTS

| | | | |
|---|---|---|---|
| 4,501,163 | A | 2/1985 | MacDermott et al. |
| 4,567,780 | A | 2/1986 | Oppenlander |
| 5,650,124 | A | 7/1997 | Gilson |

OTHER PUBLICATIONS

International Search Report for PCTEP2014069184 (dated Dec. 11, 2014).

* cited by examiner

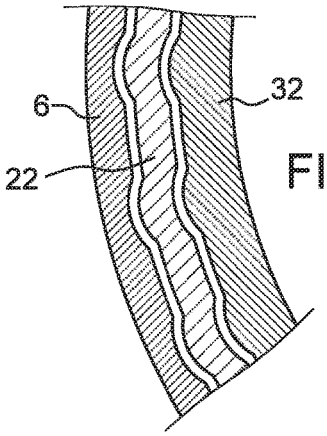
FIG.2a
FIG.2b
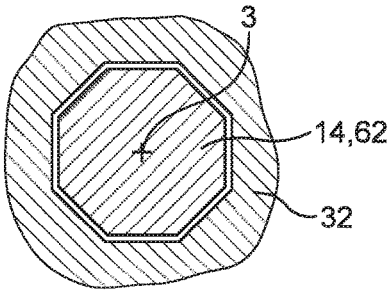
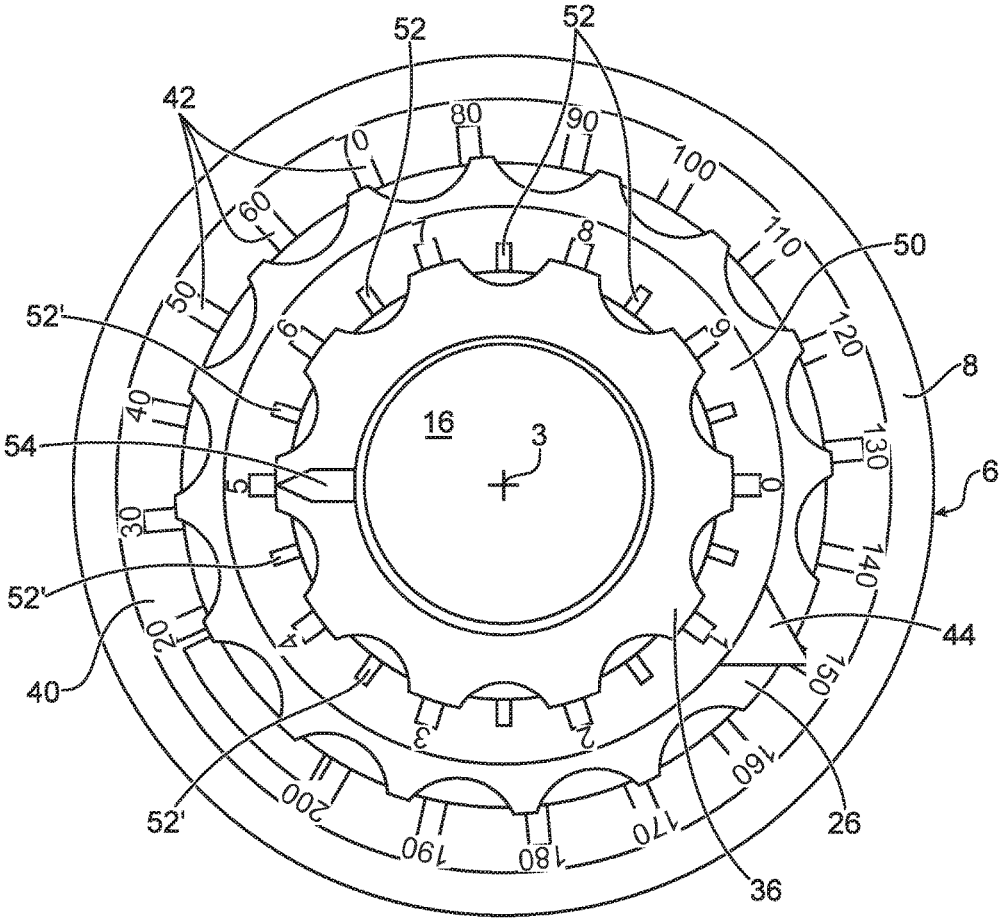
FIG.3

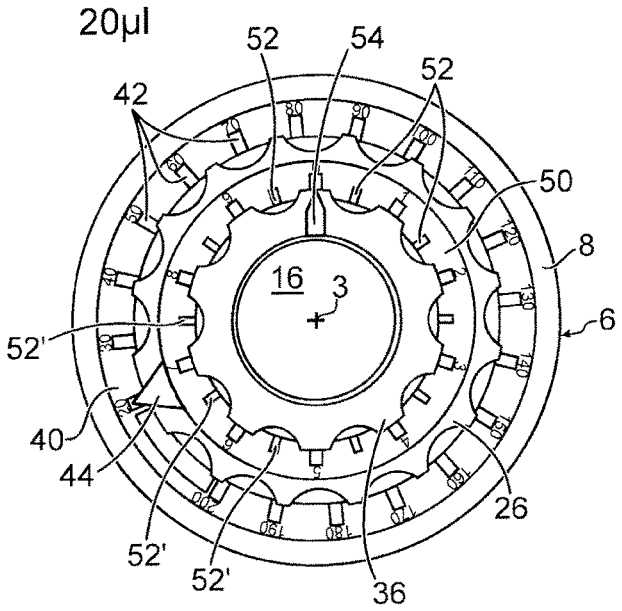
FIG.4
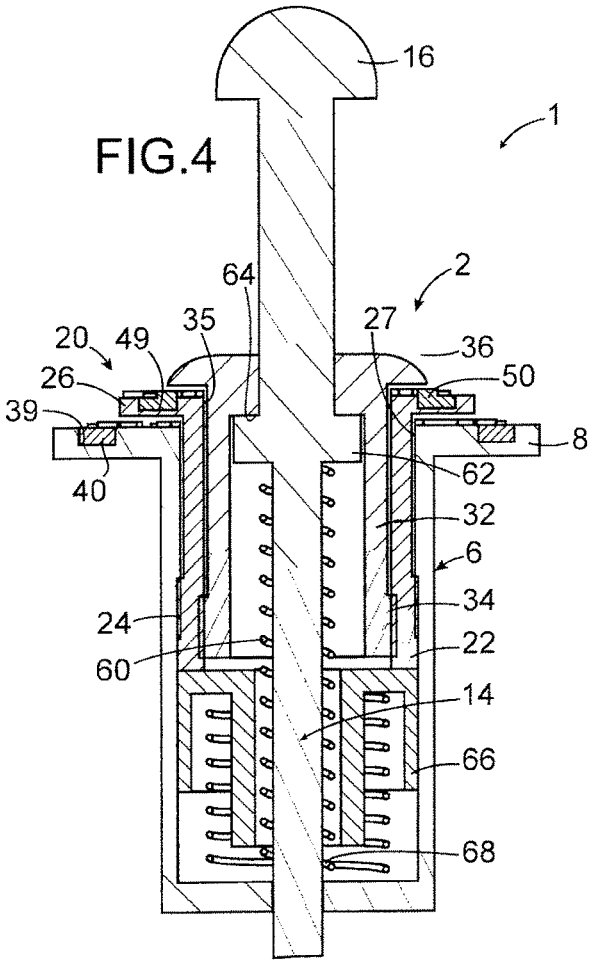

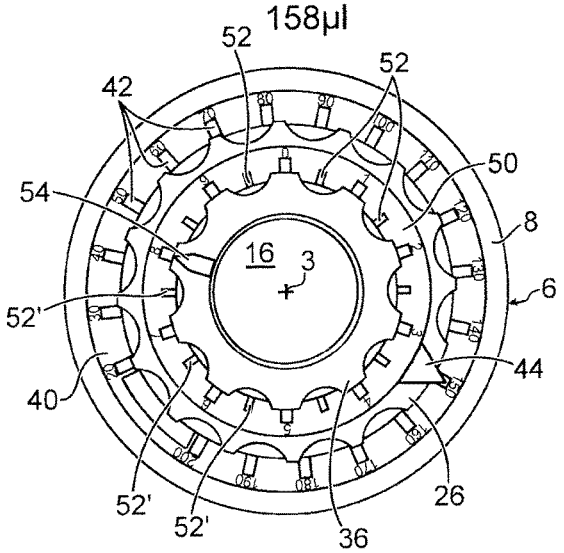
FIG.6
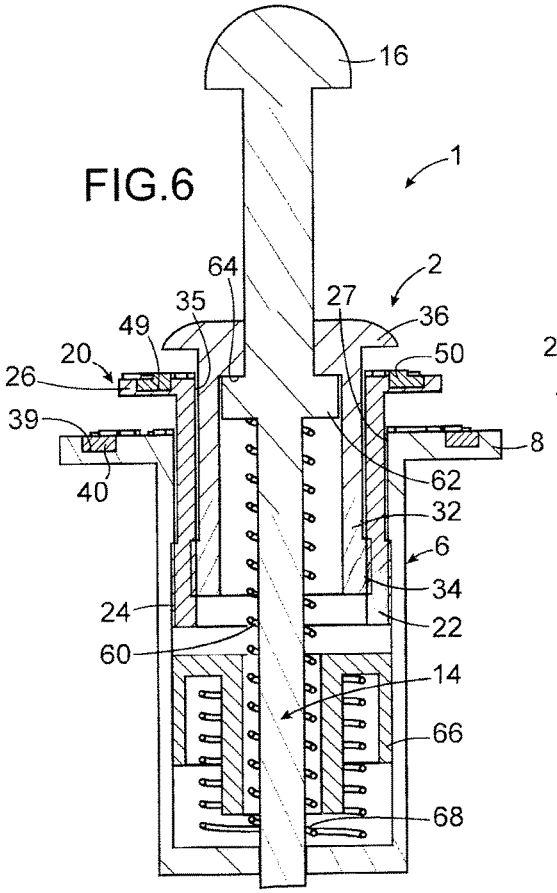
FIG.7
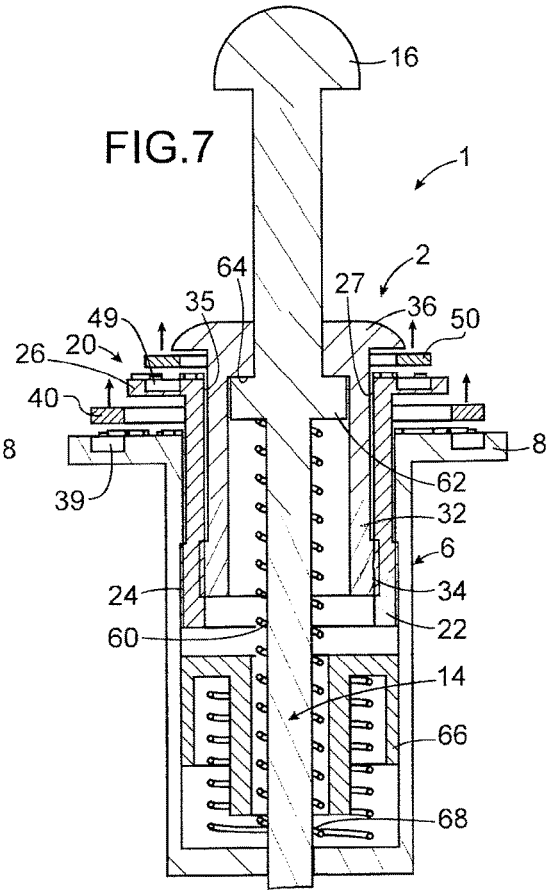

SAMPLING PIPETTE HAVING AN IMPROVED DEVICE FOR ADJUSTING AND DISPLAYING A VOLUME TO BE SAMPLED

The present invention relates to the field of pipettes, also referred to as sampling pipettes, laboratory pipettes or also liquid transfer pipettes. They are intended to sample and dispense liquid into containers or the like.

The invention more specifically relates to the hand-operated pipettes, intended to be held by hand by an operator during liquid sampling and dispensing operations, these operations being made by setting in motion a control knob obtained by applying an axial pressure on this same knob. The axial pressure applied to the control knob is transmitted to a piston of the pipette, which undergoes an axial movement and causes an air movement leading to the sampling and dispensing operations. By way of indication, the hand-operated pipettes differ from the motor-operated pipettes which are designed so that the movement of the piston is carried out under the effect of a motor driven by an electronic device, although the order of sampling stroke and dispensing stroke is also controlled by actuating a knob.

BACKGROUND

On the hand-operated pipettes, in order to be able to adapt the quantity of volume to be pipetted, a device for adjusting this volume is generally provided. By actuating this device, the initial position of the piston is moved, and the pipetting stroke of this piston is therefore modified. More precisely, actuating this adjusting device usually generates the movement of a threaded member which defines a top stop for a control stem, a top end of which carries the control knob, and a bottom end of which cooperates with the piston. So, upon adjusting the volume to be sampled, the axial movement of the threaded member and of its top stop causes, through suitable springs, the simultaneous axial movement of the control stem, the knob and the piston.

The threaded member for adjusting the volume is arranged within a hollow outer body forming a handle, which is intended to be held by the operator's hand when handling the pipette. This hollow outer body is also crossed by the control stem, and further accommodates a counter enabling the value of the adjusted volume to be displayed. This counter includes a plurality of graduated wheels cooperating with the adjusting threaded member, which drives their rotation as this member is actuated during the adjustment. To carry out this driving, gear-type connections are usually fitted between the adjusting threaded member and the wheels of the counter.

The value of the adjusted volume is displayed by means of a window provided on the outer body, this window enabling one of the graduations of each counter wheel to be read. The wheels, for example three wheels, are generally axially stacked and respectively dedicated to indicating the digit of the units, of the tens and of the hundreds. The total value of the adjusted volume is then indicated by axially/vertically reading the three digits appearing through the window laterally provided on the pipette outer body forming a handle.

This design is widely spread on hand-operated pipettes, and is satisfactory. However, there is a need for optimizing the design of the top part of these pipettes, in order to reduce their overall dimensions and/or in order to be able to fit other pipette components without excessively affecting the overall dimensions.

In the prior art, it is known to replace the counter provided with wheels with a digital counter. Nevertheless, this solution can also be improved since it can be affected by reliability issues, and it still requires a large number of components, especially a sensor. Moreover, a power supply of the digital counter is necessary.

The purpose of the invention is therefore to at least partially solve the above-indicated problems, relating to prior art implementations.

SUMMARY OF THE INVENTION

To that end, the object of the invention is first a top part for a sampling pipette comprising:

a hollow outer body forming a handle;

a pipetting control stem translationally movable inside the hollow outer body, along a longitudinal axis of the pipette;

a pipetting control knob arranged at the top end of the control stem;

a device for adjusting and displaying a volume to be sampled, comprising a first threaded member for adjusting the volume to be sampled, said first threaded member being crossed by the control stem, the device also comprising a set of first volume graduations angularly spaced from one another around the longitudinal axis and cooperating with a first mark so as to inform about the volume to be sampled.

According to the invention, said first threaded member is rotatably integral along the longitudinal axis with one of both elements formed by said set of first volume graduations and said first mark, this element being axially arranged between the hollow outer body forming a handle and said control knob.

The invention is remarkable in that the set of first graduations or the first mark is rotatably integral with the first threaded member for adjusting the volume. This design with a direct reading of the adjusted volume therefore differs from prior art counters, in which the gear-type connections were provided between the threaded member for adjusting the volume and the wheels of the counter. Removing these connections largely contributes to reducing the overall dimensions of the top part and/or to freeing free volume in the hollow body to fit other pipette components therein. This advantage is even more pronounced by means of the placement of the set of first graduations and/or of the first mark outside the hollow body forming a handle, and no longer behind a window provided through the side part of this body.

Besides, with such a design provided by the invention, the volume displayed by the graduations and the mark is preferentially read from the top of the pipette, that is with the operator's line of vision coincident with the axis of the pipette, and the control knob directed towards the operator's eyes. Another advantage is then the possibility to read permanently the adjusted volume, whatever the hand holding the pipette. This indeed differs from prior art implementations in which the side window of the counter could be masked by the operator's hand, as a function of the hand chosen to hold the pipette.

The invention preferably comprises at least one of the optional characteristics set forth below, provided individually or in combination.

Said set of first volume graduations is made on a first graduated member, preferably in a ring shape, this first graduated member and/or said first mark being configured so as to be able to be reversibly mounted, preferably by snap-fit, in several angular positions on a support member of this first graduated member/of this first mark. As will be detailed below, this feature makes it possible to considerably facilitate the pipette calibrating method. Besides, for such purposes of calibration, the number of angular positions is preferentially at least equal to the number of first graduations.

Said first mark is an index or a window.

Said first threaded member axially crosses an upper opening of the outer body forming a handle and is made in one piece with a first collar radially extending outwards from a top end of said first threaded member, said first collar carrying said element associated with the first threaded member. Alternatively, the collar could be added on the first adjusting threaded member.

Said device for adjusting and displaying a volume to be sampled further includes a second threaded member for adjusting the volume to be sampled, said second threaded member being crossed by the control stem and mounted screwed on said first threaded member, the device also comprising a set of second volume graduations angularly spaced from one another around the longitudinal axis and cooperating with a second mark so as to inform about the volume to be sampled, and said second threaded member is rotatably integral along the longitudinal axis with one of both elements formed by said set of second volume graduations and said second mark, this element being axially arranged between the hollow outer body forming a handle and said control knob.

Designs with several threaded members for adjusting the volume are therefore preferred, since they enable a great adjusting speed, while keeping a good accuracy.

In this case, it is preferentially provided that the pitch of the second threaded member is smaller than the pitch of the first threaded member, and the first and second threaded members are designed so that the extent of axial movement of the second threaded member, from an extreme axial position to the other, is equal to the extent of axial movement of the first threaded member generated when passing from any of the first graduations to the first directly consecutive graduation. In other words, it amounts to provide on the one hand a first threaded member enabling a coarse adjustment, for example with a division of value of 10 μL between two first directly successive graduations, and on the other hand a second threaded member enabling a fine adjustment, for example with ten second graduations and a division of value of 1 μL between two second directly successive graduations.

Of course, the number of adjusting threaded members could be higher than two, without departing from the scope of the invention. In the case of two threaded members, the solution is particularly advantageous since it provides a simplified adjustment. Indeed, it becomes possible to adjust any volume of the pipette operating range by performing at most two revolutions, namely one revolution at maximum for the first threaded member and one revolution at maximum for the second threaded member. Furthermore, in this case with several threaded members providing more or less fine adjustments, the set of graduations associated with the coarser adjustment enables an accurate indication on the pipette operating range to be given, thanks to its two extreme values which are preferentially visible externally and permanently on the pipette, by looking at the pipette from the top. This enables the operator to identify at any time the pipette model he/she uses.

Still among the optional characteristics, it is provided that said set of second volume graduations is made on a second graduated member, preferably in a ring shape, and that this second graduated member and/or said second mark are configured so as to be able to be reversibly mounted, preferably by snap-fit, in several angular positions on a support member of this second graduated member/this second mark. As mentioned above for the first member, this makes it possible to facilitate the calibration operations. So, the number of angular positions is here also preferably at least equal to the number of second graduations.

Likewise, said second mark is an index or a window.

Preferably, the second threaded member axially crosses an upper opening of the first threaded element and is made in one piece with a second collar radially extending outwards from a top end of the second threaded member, said second collar carrying said element associated with said second threaded member. Here again, a solution with an added collar is worth considering, without departing from the scope of the invention.

Preferably, the first collar is axially arranged between the second collar and the hollow outer body forming a handle, and said first collar carrying said element associated with the first threaded member also carries the other of both elements formed by said set of second volume graduations and said second mark. Of course, a reverse position between both collars is also possible, by providing the second threaded member screwed externally on the first threaded member, and not the opposite.

Preferably, the other of both elements formed by said set of first volume graduations and said first mark is carried by the hollow outer body forming a handle, preferably by an upper surface of this body, substantially orthogonal to the longitudinal axis of the pipette.

Preferably, the first and/or second collars form means for rotatably actuating first/second threaded members for adjusting the volume to be sampled. This feature, which is of course also valid for the solutions with a single adjusting threaded member, enables the design of the pipette to be still further simplified. Indeed, these collars, fitted with graduations and/or associated marks, thus enable two distinct functions to be fulfilled, namely the adjustment of the volume and the display of the adjusted volume.

Furthermore, the control stem can form means for rotatably actuating the second threaded member, the driving in rotation of the second threaded member by the control stem crossing it being preferably performed by shape cooperation. It is thus possible to actuate the second threaded member with the second collar and/or with the control stem, via the control knob. Naturally, this possibility is also provided for the designs with a single threaded member.

Preferably, the second threaded member defines a top stop for the pipetting stroke of the control stem. Here again, for the solutions with a single adjusting threaded member, this stop can be defined by this single threaded member.

The object of the invention is also a sampling pipette comprising a top part such as described above.

Finally, the object of the invention is also a method for calibrating a sampling pipette, including the following successive steps:

(a) adjusting a target volume to be sampled using said adjusting and displaying device provided on the top part of the pipette;

(b) sampling liquid using the pipette;

(c) measuring the volume of liquid sampled by the pipette; and (d) when the measurement value is different from the value of the target volume, disassembling at least one of the elements among the first and second threaded members and the first and second marks, and then re-assembling said disassembled element(s) in one or different angular positions on their associated support members, so that they display the value of said measurement.

The calibration thus carried out is extremely quick, since it requires only one measurement. In particular, it differs from the previously used methods based on the trial and error principle, requiring several measurements.

Further advantages and characteristics of the invention will appear in the non-limiting detailed description below.

BRIEF DESCRIPTION OF THE DRAWINGS

The description will be made with reference to the accompanying drawings among which;

FIGS. 2*a* and 2*b* are cross-section views respectively taken along the lines A-A and B-B of FIG. 2;

FIG. 3 depicts a top view of the pipette shown in FIGS. 1 and 2;

FIGS. 4 to 6 show the pipette in different successive states during an adjusting operation of the volume to be sampled; and FIG. 7 schematically depicts a particular step of a method for calibrating the pipette shown in the previous figures.

DETAILED DESCRIPTION

Figure 1:
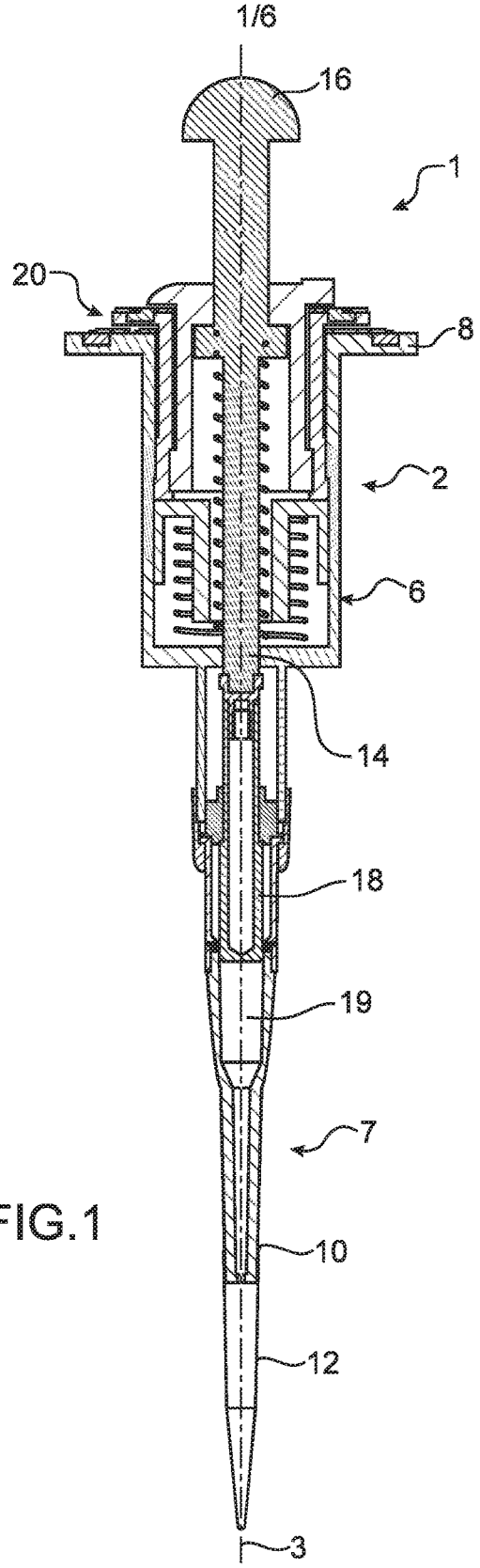
FIG. 1 depicts a partially schematic longitudinal cross-section view of a hand-operated sampling pipette with air movement, according to a preferred embodiment of the present invention.

With reference first to FIG. 1, it is depicted a hand-operated sampling pipette 1 with air movement, according to a preferred embodiment of the present invention. Throughout the following description, the terms <<top>> and <<bottom>> are to be considered with the pipette held vertically, in a pipetting position or a position close to the same, as is the case in FIG. 1. In a known manner, a hand operated pipette is intended to be held by an operator's hand, who, using his/her thumb, actuates the pipette to cause a liquid which has been previously drawn to be dispensed.

More precisely, the pipette 1 with a longitudinal axis 3 comprises a top part 2 fitted with a hollow outer body forming a handle 6. The body 6, as nearly all the component parts of the pipette, has the general shape of a revolution centred on the axis 3. At the top part, the body 6 includes a rim 8 on which the operator's hand is intended to be placed during pipetting.

The body 6 is connected at its lower end to a pipette bottom part 7, which ends by a tip 10 carrying a sampling cone 12 fitted on this tip. Conventionally, a system (not depicted) for ejecting the cone is also provided on the pipette.

The connection between a top part 2 and the bottom part 7 is preferably made by screwing.

The top part 2 also includes a pipetting control stem 14 carrying at its top end a control knob 16 intended to undergo the pressure of the operator's thumb. The stem 14 is translationally movable inside the body 6, along the axis 3. Moreover, at the bottom part, the stem 14 controls the movement of a piston 18 in a suction chamber 19 provided in the bottom part. So, by being fixed to each other and/or under the effect of elastic return means and stops, the knob 16, the stem 14 and the piston 18 simultaneously move along the axis 3 when the knob 16 is pressed by the operator, and when this pressure is released. By way of indication, the stem 14 and the piston 18 can be made in one piece, or made separately and then added on one another.

Figure 2:
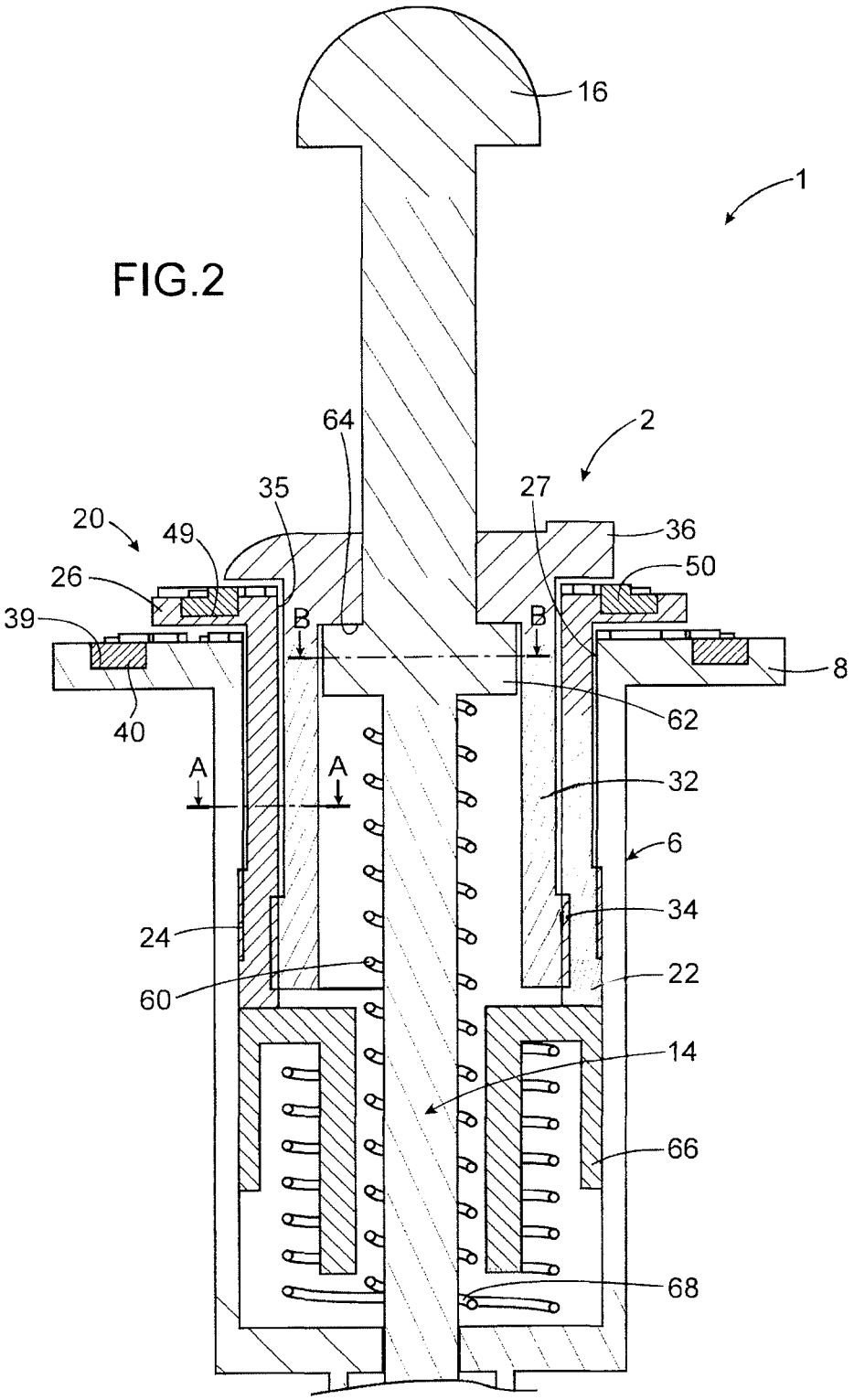
FIG. 2 depicts an enlarged view of the top part of the pipette shown in FIG. 1.

The top part 2 also includes a device 20 for adjusting and displaying a volume to be sampled, specific to the invention and which will be described more precisely with reference to FIGS. 2 to 3.

It comprises a first threaded member 22 for adjusting the volume to be sampled, also referred to as an adjusting screw. This member 22 is hollow and crossed by the stem 14. It has an outer thread 24 cooperating with a corresponding thread provided on the inner surface of the body 6. It is a member enabling the volume to be sampled to be coarsely adjusted, with a high pitch P1 provided accordingly.

The member 22 extends upwards inside the body 6, until it axially crosses an upper opening 27 thereof. It therefore extends upwards beyond the handle 6, and its top end is integral with a first collar 26 radially extending outwards. The collar 26 is preferentially made in one piece with the threaded member 22. It covers part of the rim 8 of the body 6, by being arranged substantially parallel to this rim. As will be explained later, the collar 26 has several functions, among which the actuating of the threaded member 22, with which it is of course rotatably integral along the axis 3.

Furthermore, the device 20 comprises a second threaded member 32 for adjusting the volume to be sampled, also referred to as an adjusting screw. This member 32 is hollow and crossed by the stem 14. It has an outer thread 34 cooperating with a corresponding thread provided on the inner surface of the first threaded member 22. It is a member enabling the volume to be sampled to be finely adjusted, with a low pitch P2, smaller than the pitch P1.

The member 32 extends upwards inside the body 6 and inside the first threaded member 22, until it axially crosses the upper opening 35 thereof. The member 32 therefore extends upwards beyond the handle and the first collar 26, and its top end is integral with a second collar 36 radially extending outwards. The collar 36 is preferentially made in one piece with the threaded member 32. It covers part of the collar 26 by being arranged substantially parallel thereof, the radial extent of the first collar 26 being greater than the one of the second collar 36. Here also, as will be explained later, the collar 36 has several functions, among which the actuating of the threaded member 32 with which it is rotatably integral along the axis 3.

Both collars 26, 36 are thus concentric, arranged around the stem 14, and axially located between the upper rim 8 of the handle 6 and the pipetting control knob 16.

The rim 8 has a groove 39 in which a ring 40 forming a graduated member is reversibly inserted. On this ring 40, is provided a set of first volume graduations 42, angularly spaced from one another along the axis 3. These first graduations 42 define angular divisions between each other, for example of a value of 10 μL. In the depicted example, the graduations 42 present around a circle centred on the axis 3 are distributed on nearly 360°, from the smallest sampling value, 20 μL, to the largest sampling value, 200 μL.

Besides, the first collar 26 carries a mark formed by an index 44 cooperating with the first graduations 42. So, by superimposing the pipette along the longitudinal direction, the index 44 points at one of the graduations 42 indicating the adjustment ensured by the first threaded member.

Similarly, the first collar 26 has a groove 49 in which a ring 50 forming a graduated member is reversibly inserted. On this ring 50, is provided a set of second volume graduations 52, angularly spaced from one another along the axis 3. These second graduations 52 define angular divisions between each other, for example of a value of 1 μL. In the depicted example, the graduations 52, present around a circle centred on the axis 3, are distributed on nearly 360°, from 0 to 9 μL. Intermediate graduations 52' can possibly be placed between the second graduations 52, so as to adjust/display the volume to the nearest half-millimeter.

The second collar 36 carries a mark formed by an index 54 cooperating with the first graduations 52 and the intermediate graduations 52'. So, by superimposing the pipette along the longitudinal direction, the index 54 points at one of the graduations 52, 52', indicating the adjustment ensured by the second threaded member.

In view on the above, the total volume variation provided by the fine adjusting member 32 corresponds to the division value between first two graduations 42 of the coarse member 22, which enables a great adjusting accuracy. In other words, the first and second threaded members 22, 32 are designed so that the extent of axial movement of the second threaded member 32, from an extreme axial position to the other, is equal to the extent of axial movement of the first threaded member 32 passing from any first graduation 42 to the following graduation.

When they are inserted in their corresponding grooves 39, 49, the graduated rings 40, 50 are rotatably integral with the piece forming the groove, in the same way as the indexes 44, 54 as sliders are also rotatably integral with the collars 26, 36, respectively. Nevertheless, the graduated rings 40, 50 are reversibly mounted in their grooves, that is they can be extracted without being damaged, and then later reassembled in different angular positions. This enables the method for calibrating the pipette to be facilitated, as will be detailed later. Assembling the graduated rings 40, 50 in their respective grooves is preferably performed by snap-fit or any other similar technique requiring no tool, or requiring a very conventional tool.

It is to be noted that to ensure the rotation blocking of each graduated ring 40, 50 with its support member 8, 26, along the axis 3, complementary geometries of the recessed and protruding type can be provided on the periphery of the ring and on the outer flank of its associated groove.

The pipette top part 2 also includes a spring 60 returning the stem 14 and the piston to the top position. This spring 60, which surrounds the stem 14, has for example a bottom end bearing against a bottom end of the handle 6, and a top end bearing against a shoulder 62 provided on the stem. The shoulder 62, undergoing the strain of the spring 60, is pressed against a pipetting stroke top stop 64 provided on the top end of the second threaded member 22. Moreover, the periphery of the shoulder 62 has a shape complementarity with the inner surface of the second threaded member for adjusting the volume 32, so as to enable the latter to be driven in rotation by the knob 16, via the stem 14. FIG. 2*b* depicts an exemplary implementation in which the complementary shapes have polygonal geometries.

So, the stem 14 forms a mean for rotatably actuating the second threaded member for adjusting the volume 32, since the rotation along the axis 3 of this stem 14, via the knob 16, causes a rotation of the same amplitude of the threaded member 32.

To adjust the volume to be sampled, the operator can therefore act on both threaded members 22, 32. The first threaded member 22 can be actuated by the first collar 26, the rotation of which along the axis 3 causes a rotation of the same amplitude of the first threaded member 22. The operator gives priority to this first member 22 to start his/her adjustment, since it is the threaded member associated with the coarse adjustment. This actuation is therefore performed outside the hollow body 6, by rotating the collar 26 until the index 44 points at the first desired graduation 42. This enables the volume to be adjusted to the nearest 10 μL.

To refine the adjustment, the operator can then act on the second threaded member 32. The latter can be actuated by the second collar 36 or by the control stem 14. In both cases, the rotation along the axis 3 causes a rotation of the same amplitude of the second threaded member 32. This actuation is also performed outside the hollow body 6, by rotating the collar 36 or the stem 14 until the index 54 points at the second desired graduation 52, or at an intermediate graduation 52'. This enables the volume to be adjusted to the nearest 0.5 μL.

As is schematized in FIG. 2*a*, connections with notches or similar can be provided between the body 6, the member 22 and the member 32, so that both members can be rotatably held in each desired adjusting position. So, to pass from a graduation to another, the strain developed by the operator rotating the collars 26, 36 must overcome the holding strains resulting from the cooperation of the notches with the recesses. These holding strains are preferentially small, but sufficiently high for the volume not to be accidentally disrupted when handling the pipette. This arrangement thus differs from the one of the graduated rings 40, 50 in their grooves, since in the latter case, a relative rotation can only be obtained by removing these rings from the grooves, and by replacing them in different angular positions.

This original design with recesses and notches replaces prior art systems in which the control means are generally associated with these engageable means to prevent the volume from being accidentally disrupted when handling the pipette. This is beneficial in terms of overall dimensions and of weight.

As mentioned above, the rotation of the threaded members 22, 32 causes their movement along the axis 3, and therefore creates a movement of the pipetting stroke top stop 64. Under the effect of the spring 60, the set comprising the knob 16, the stem 14 and the piston is moved by a same vertical distance, which directly influences the pipetting stroke. In this respect, it is noted that the pipetting stroke bottom stop is performed by a piece 66 accommodated at the bottom of the hollow body 6, and slidingly moving along the axis 3. A spring 68 with a greater rate than the one of the spring 60 is interposed between this piece 66 and the bottom of the hollow body 6. It is a draining spring, enabling the piston to perform a draining stroke in a conventional way, known from those skilled in the art.

With this design, the volume displayed by the graduations and the corresponding indexes can be read from the top of the pipette, that is with the operator's line of vision coincident with the axis 3, and the knob 16 directed towards the operator's eyes. More preciously, it is the radial correspondence between the graduations and their indexes which makes it possible to read the total volume, which is determined by adding the volume indicated by the first index 44, and the one indicated by the second index 54.

Besides the fact that any volume can be very quickly adjusted by performing a maximum rotation of 360° with the first collar 26 and a maximum rotation of 360° with the second collar 36, the advantage of the chosen design is to be able to permanently read the adjusted volume, whatever the hand holding the pipette. Indeed, the operator's hand is located under the rim 8 of the handle 6, whereas the graduated rings 40, 50 and the indexes 44, 54 are axially arranged externally relative to the body 6, between the latter and the control knob 16. The pipette operating range can also be read at any time by the operator, by means of the first and second graduations permanently visible from the top of the pipette.

Figure 5:
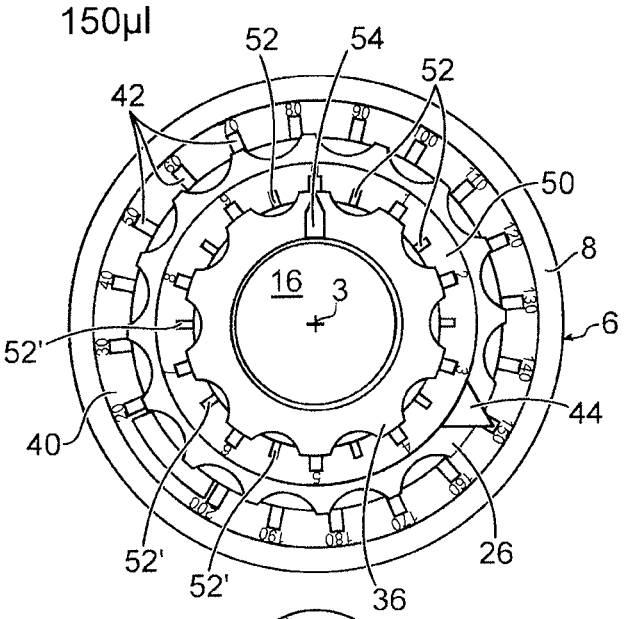
Figure 5:
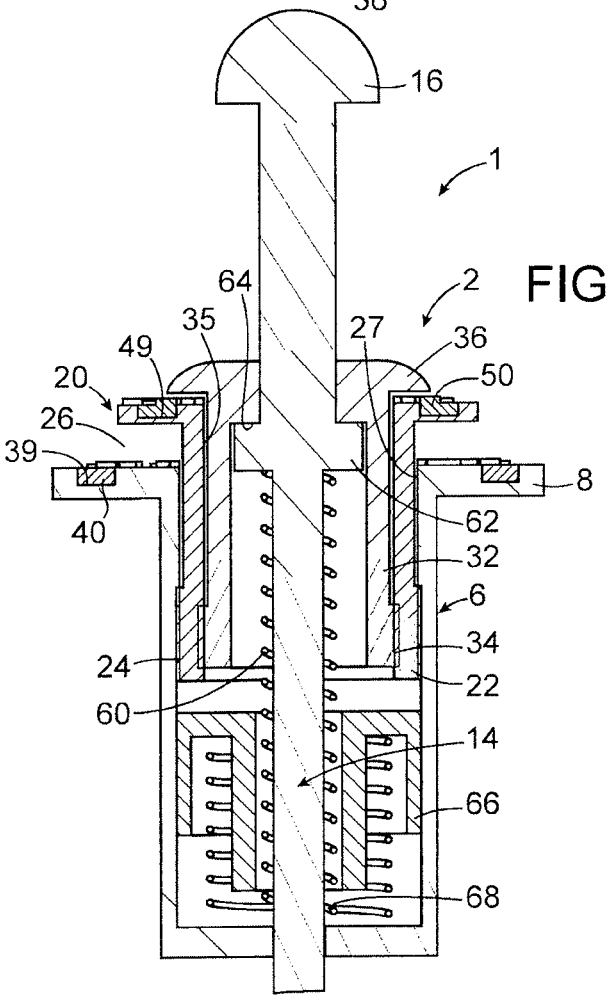

FIGS. 4 to 6 show different steps of adjusting the volume on the above-described pipette. Here, the desired volume is 158 μL.

First, the collar 26, axially arranged between the handle rim 8 and the second collar 36, is actuated to bring the index 44 of the first graduation 42 indicating 20 μL as shown in FIG. 4, to the first graduation 42 indicating 150 μL as shown in FIG. 5. This rotation causes the axial movement of the threaded member 22, and an upward movement of the pipetting stroke top stop 64. Then, the first collar 26 fitted with the second graduated ring 50 and with the first index 44 remains fixed, but it is the second collar 36 which is rotatably actuated to bring the index 54 of the second graduation 52 indicating 0 μL as shown in FIG. 5, to the second graduation 52 indicating 8 μL as shown in FIG. 6. This rotation causes a new axial movement, of the threaded member 32, and thus creates a new upward movement of the pipetting stroke top stop 64.

FIG. 7 depicts one of the steps of a method for calibrating the pipette 1, according to a preferred embodiment of the invention.

First, to implement this method, an adjustment of a target volume to be sampled is performed using the adjusting and displaying device 20.

Subsequently, liquid is sampled using the pipette 1 thus adjusted, then, after dispensing this volume, the latter is measured by a conventional technique.

When the value of measurement of the sampled volume is different from the value of the target volume, the method simply consists in dismounting one or both graduated rings 40, 50 initially snap-fitted in their grooves 39, 49, as schematized in FIG. 7, then these rings 40, 50 are subsequently reassembled in different angular positions in these grooves, so as to display, via the corresponding indexes, the value of the measurement. To enable an accurate calibration, for each graduated ring 40, 50, it is preferentially provided that the number of possible angular positions for mounting this ring in its groove, is at least equal to the number of marked graduations on this ring.

Such a calibration is quick and easy to be made, and it can be implemented by the operator himself/herself.

Of course, various modifications can be brought by those skilled in the art to the invention which has just been described, only by way of non-limiting examples.

The invention claimed is:

1. A top part for a sampling pipette comprising:

a hollow outer body forming a handle;

a pipetting control stem translationally movable inside the hollow outer body, along a longitudinal axis of the pipette;

a pipetting control knob arranged at the top end of the control stem;

a device for adjusting and displaying a volume to be sampled, comprising a first threaded member for adjusting the volume to be sampled, said first threaded member being crossed by the control stem, the device also comprising a set of first volume graduations angularly spaced from one another around the longitudinal axis and cooperating with a first mark so as to inform about the volume to be sampled, wherein said first threaded member is rotatably integral along the longitudinal axis with one element selected from said set of first volume graduations and said first mark, said one element being axially arranged between the hollow outer body forming a handle and said control knob, and wherein the top part is constructed such that said set of first volume graduation and said first mark can be read from the top part in a view taken substantially in a direction of the longitudinal axis, with the first mark designating one of said first volume graduations.

2. The pipette top part according to claim 1, wherein said set of first volume graduations is made on a first graduated member, and wherein said first graduated member or said first mark are configured to be able to be reversibly mounted in several angular positions on a support member.

3. The pipette top part according to claim 2, wherein a number of angular positions is at least equal to a number of first graduations.

4. The pipette top part according to claim 1, wherein said first mark is an index or a window.

5. The pipette top part according to claim 1, wherein said first threaded member axially crosses an upper opening of the hollow outer body forming a handle and is made in one piece with a first collar radially extending outwards from a top end of said first threaded member, said first collar carrying said one element selected from said set of first volume graduations and said first mark and associated with the first threaded member.

6. The pipette top part according to claim 1, wherein said device for adjusting and displaying a volume to be sampled further includes a second threaded member for adjusting the volume to be sampled, said second threaded member being crossed by the control stem and mounted on said first threaded member, the device also comprising a set of second volume graduations angularly spaced from one another around the longitudinal axis and cooperating with a second mark so as to inform about the volume to be sampled, and wherein said second threaded member is rotatably integral along the longitudinal axis with one element selected from said set of second volume graduations and said second mark, said one element selected from said set of second volume graduations and said second mark and being axially arranged between the hollow outer body forming a handle and said control knob.

7. The pipette top part according to claim 6, wherein a pitch of the second threaded member is smaller than a pitch of the first threaded member, and wherein the first and second threaded members are constructed so that the extent of axial movement of the second threaded member, from one extreme axial position to another extreme axial position, is equal to the extent of axial movement of the first threaded member generated when passing from any of the first volume graduations to a first directly consecutive graduation.

8. The pipette top part according to claim 6, wherein said set of second volume graduations is made on a second graduated member, and wherein said second graduated member or said second mark is configured to be able to be reversibly mounted in several angular positions on a support member of this second graduated member or the second mark.

9. The pipette top part according to claim 8, wherein a number of angular positions is at least equal to a number of second graduations.

10. The pipette top part according to claim 6, wherein said second mark is an index or a window.

11. The pipette top part according to claim 6, wherein said second threaded member axially crosses an upper opening of the first threaded member and is made in one piece with a second collar radially extending outwards from a top end of said second threaded member, said second collar carrying said element associated with the second threaded member.

12. The pipette top part according to claim 11, wherein said first threaded member axially crosses an upper opening of the hollow outer body forming a handle and is made in one piece with a first collar radially extending outwards from a top end of said first threaded member, said first collar carrying said element associated with the first threaded member, wherein the first collar is axially arranged between the second collar and the hollow outer body forming a handle, and wherein said first collar carrying said element associated with the first threaded member, also carries another of two elements formed by said set of second volume graduations and said second mark.

13. The pipette top part according to claim 12, wherein the other of said two elements formed by said set of first volume graduations and said first mark is carried by the hollow outer body forming a handle.

14. The pipette top part according to claim 11, wherein the first and/or second collars form means for rotatably actuating the first and second threaded members for adjusting the volume to be sampled.

15. The pipette top part according to claim 6, wherein the control stem forms means for rotatably actuating the second threaded member, the driving in rotation of the second threaded member by the control stem crossing it being made by shape cooperation.

16. The pipette top part according to claim 6, wherein said second threaded member defines a top stop for the pipetting stroke of the control stem.

17. A sampling pipette comprising a top part according to claim 1.

18. A method for calibrating sampling a pipette comprising a top part which includes a hollow outer body forming a handle, a pipetting control stem translationally movable inside the hollow outer body, along a longitudinal axis of the pipette, a pipetting control knob arranged at the top end of the control stem, a device for adjusting and displaying a volume to be sampled, comprising a first threaded member for adjusting the volume to be sampled, said first threaded member being crossed by the control stem, the device also comprising a set of first volume graduations angularly spaced from one another around the longitudinal axis and cooperating with a first mark so as to inform about the volume to be sampled, wherein said first threaded member is rotatably integral along the longitudinal axis with one of two elements formed by said set of first volume graduations and said first mark, this said one element being axially arranged between the hollow outer body forming a handle and said control knob, wherein said set of first volume graduations is made on a first graduated member, and wherein said first graduated member or said first mark are configured to be able to be reversibly mounted in several angular positions on a support member of said first graduated member or the first mark, wherein the method comprises the following successive steps:

(a) adjusting a target volume to be sampled using said device for adjusting and displaying provided on the top part of the pipette;

(b) sampling liquid using the pipette;

(c) measuring the volume of liquid sampled by the pipette; and (d) when the volume of liquid sampled by the pipette is different from the target volume, disassembling at least one element of the first threaded member, a second threaded member, the first mark, and a second mark, and then re-assembling said one element in a different angular position to display a measurement value.

19. The pipette top part according to claim 2, wherein said set of first volume graduations is made on a first graduated member in a ring shape.

20. The pipette top part according to claim 2, wherein said support member of said first graduated member and said first mark are reversibly mounted by snap-fit.

21. The pipette top part according to claim 8, wherein said set of second volume graduations is made on a second graduated member in a ring shape.

22. The pipette top part according to claim 8, wherein said support member of said second graduated member and said second mark are reversibly mounted by snap-fit.

* * * * *